US008240347B2

(12) United States Patent
Ishida

(10) Patent No.: US 8,240,347 B2
(45) Date of Patent: Aug. 14, 2012

(54) CUTTING BOARD

(76) Inventor: Katsumasa Kei Ishida, Helendale, CA (US)

( * ) Notice: Subject to any disclaimer, the term of this patent is extended or adjusted under 35 U.S.C. 154(b) by 121 days.

(21) Appl. No.: 12/541,281

(22) Filed: Aug. 14, 2009

(65) Prior Publication Data

US 2011/0036456 A1 Feb. 17, 2011

(51) Int. Cl.
*B27C 5/00* (2006.01)

(52) U.S. Cl. ..... 144/144.1; 144/144.51; 144/285; 144/359; 144/376

(58) Field of Classification Search ..... 144/285–287, 144/144.1, 144.51, 359, 362, 376; 108/50.11, 108/51.11, 90, 161
See application file for complete search history.

(56) References Cited

U.S. PATENT DOCUMENTS 2,812,219 A * 11/1957 Lange ..... 182/186.5
3,186,452 A * 6/1965 Magnussen ..... 83/745
4,457,399 A * 7/1984 Breisch ..... 182/185.1
4,991,354 A * 2/1991 Schweickhardt ..... 451/188
5,694,994 A * 12/1997 Engler et al. ..... 144/286.1
5,740,847 A * 4/1998 Lakso ..... 144/144.52
5,775,395 A * 7/1998 Wilkins ..... 144/286.5
5,839,540 A * 11/1998 Russell ..... 182/153
6,196,285 B1 * 3/2001 Tahvonen ..... 144/286.5
7,628,186 B2 * 12/2009 Blum ..... 144/286.1
7,931,057 B2 * 4/2011 Chung et al. ..... 144/286.1
2007/0131306 A1 * 6/2007 Snider ..... 144/286.1
2007/0235107 A1 * 10/2007 Winskunas ..... 144/286.1
2010/0282133 A1 * 11/2010 Wong ..... 108/50.11

* cited by examiner

*Primary Examiner* — Bena Miller
(74) *Attorney, Agent, or Firm* — Lightbulb IP, LLC

(57) ABSTRACT

A cutting board provides support to large pieces of wood during cutting or shaping. The cutting board supports a piece of wood across its surface area to prevent the wood from bending, cracking, or breaking as it is cut. This allows the wood to be cut accurately and safely by a single person. The cutting board may include a generally planar work surface and have one or more openings. The one or more openings may be configured to reduce weight, allow clamps to be easily installed, and allow sawdust to escape. The cutting board may be placed on a variety of supporting structures or surfaces. In one or more embodiments, the cutting board may be modular to allow a plurality of cutting boards to be connected together to form a larger work surface. Other materials may be cut or shaped on the cutting board as well.

5 Claims, 9 Drawing Sheets

CUTTING BOARD

BACKGROUND OF THE INVENTION

1. Field of the Invention

The invention relates generally woodworking tools and in particular to a cutting board for wood.

2. Related Art

As is known, lumber or wood is used as a building material for buildings, furniture, and other structures. To ensure a good fit between wooden parts of these structures, it is essential to cut or shape these parts accurately. In the case of building for example, a good fit between wooden parts helps ensure the building is structurally sound. In the case of furniture, a good fit between wooden parts shows quality craftsmanship and provides durability.

Woodworking or carpentry projects often require relatively large pieces of wood in their construction. This wood may be natural or engineered wood and may come in lengths or sizes which are unwieldy to a single person. For example, a standard sheet of plywood, MDF, particle board, or the like is typically 4×8 ft. This makes it difficult to cut the wood as desired. Typically, such large sheets are cut with only one side supported, or with the sheet or stick only supported on each end by a saw horse.

The problem may be somewhat mitigated when there are two or more people working together or with specialized tools. However, oftentimes, such as in the case of hobbyists or individual builders, only one person is working on the woodworking or carpentry project. In addition, specialized tools may be expensive and, in some cases, require a large workshop or work area.

Wood is unforgiving when mistakes are made in shaping or cutting wood. For example, it is common for large pieces of wood to chip or crack if unsupported when cut. In addition, these chips, cracks, or other blemishes are readily visible in projects such as furniture and finish carpentry. Also, in many cases, if a cut is improperly made, the cut piece can no longer be used for the project at hand. This leads to waste and additional expense in material costs. In addition, an individual attempting to simultaneously cut and support a piece of wood may be injured by the saw.

From the discussion that follows, it will become apparent that the present invention addresses the deficiencies associated with the prior art while providing numerous additional advantages and benefits not contemplated or possible with prior art constructions.

SUMMARY OF THE INVENTION

A cutting board for cutting wood is provided herein. The cutting board supports a piece of wood across the surface area of the wood to prevent the wood from bending, cracking, and breaking as it is being cut. This allows a single person to safely and accurately make cuts into the wood. Typically, the cutting board will be used to cut panels or sheets of wood, such as plywood. Of course, other materials, including materials not made of wood, may be cut on the cutting board. The cutting board may be configured to be easily transported and set up by a single user.

The cutting board may have various configurations. In one embodiment, the cutting board comprises a body having a top and a bottom, and a work surface at the top of the body to support the piece of wood. It is contemplated that the body may be rigid or flexible. In addition, the body may have a height greater than the depth of a cutting blade to prevent the cutting blade from cutting through the cutting board. The work surface may have a texture for gripping the piece of wood, or a plurality of raised dimples in some embodiments. It is noted that a second work surface may be provided at the bottom of the body.

A plurality of openings extending through the body from the top to the bottom of the body may be provided as well. The plurality of openings may be arranged in a plurality of straight rows across the body. The one or more openings may have a first shape at the top of the body and a second shape at the bottom of the body in some embodiments.

The cutting board may also comprise one or more mounts at least one edge of the body. The one or more mounts may be configured to extend the work surface of the cutting board by connecting the cutting board to another cutting board. The one or more mounts may be connecting structures selected from the group consisting of openings, tabs, and slots.

In one embodiment, the cutting board may comprise a body having a top and a bottom, a work surface at the top of the body configured to support a piece of wood, and one or more openings in the body. Similar to the above, the one or more openings may extend through the body from the top to the bottom of the body. In addition, the body may have a height greater than the depth of a cutting blade to prevent the cutting blade from cutting through the cutting board. One or more mounts on at least one edge of the body and configured to extend the work surface of the cutting board by connecting the cutting board to another cutting board may be included as well. It is noted that the work surface may be formed from a different material than the body. Also, in some embodiments, one or more channels may be provided in the work surface to prevent a cutting blade from cutting into the work surface when a piece of wood is cut.

A method of cutting a panel with the cutting board is also provided herein. The panel may be wood, such as plywood or the like, or the panel may be another material. In one embodiment, the method comprises placing a cutting board on one or more supports, and laying the panel to be cut on a work surface of the cutting board such that the panel covers one or more openings in the cutting board. The panel may then be cut with a cutting tool having a cutting blade. The cutting tool may be a variety of cutting or shaping tools. For example, the cutting tool may be a circular saw having a circular cutting blade. During the cut, a portion of the panel beyond the cutting blade may be supported by the cutting board. In one or more embodiments, the one or more pieces of the panel resulting from the cut continue to be supported after the cut.

A portion of the work surface may be cut into with the cutting blade as the panel is cut because the cutting blade may extend beyond the width of the panel. The cutting blade may be adjusted to a particular depth of cut according to one or more guides on the cutting board. Alternatively or in addition, the panel may be positioned over a channel in the work surface rather than cutting into a portion of the work surface with the cutting blade as the panel is cut. To position the panel in this manner, the panel may be positioned to align a cut to be made in the panel with the channel in the work surface.

According to the method, one or more additional cutting boards may be connected to the cutting board to create a larger work surface if desired. Clamps may also be used during panel cutting as well. For example, a clamp may be inserted through at least one of the one or more openings and used to clamp the panel to the cutting board. Also or alternatively, a user may stand on the panel while cutting the panel. In this manner, the user's weight may be used to hold the panel in place during cutting.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views.

DETAILED DESCRIPTION OF THE PREFERRED EMBODIMENTS

Figure 1A:
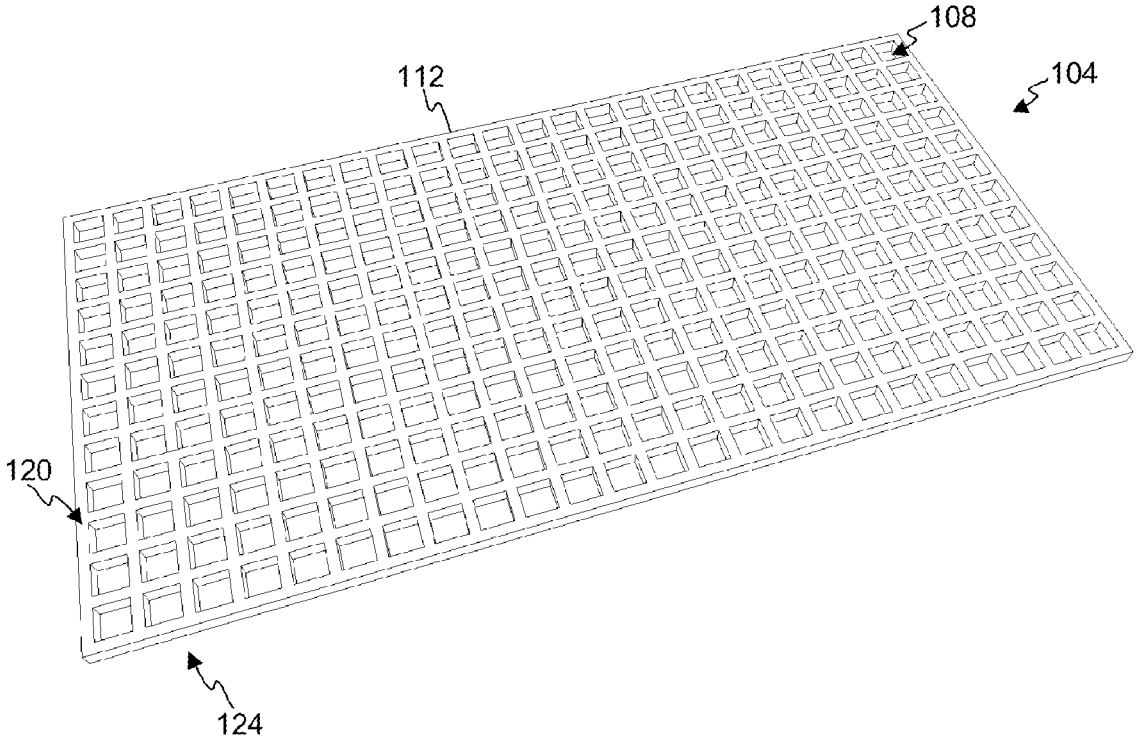
FIG. 1A is a perspective view of an exemplary cutting board.

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

The cutting board disclosed herein provides numerous benefits with regard to cutting wood. As will be discussed further below, the cutting board utilizes a unique structure to support wood of various sizes during cutting. This allows even unwieldy pieces of wood to be easily cut by an individual user (i.e. without help from another person), while preventing chips, cracks, or other blemishes. Of course, the cutting board may also be used to cut smaller pieces of wood as well. In fact, in one or more embodiments, the cutting board may be modular to suit wood of various sizes. The cutting board also increases safety during cutting, and provides a work surface which allows accurate cuts to be easily made. In addition, the cutting board may be inexpensively manufactured, is highly reliable, and can be used in small or confined spaces.

In general, the cutting board allows an individual user, such as a carpenter or other craftsman, to easily, safely, and accurately cut large pieces of wood in sheet or panel form. This is highly beneficial because woodworking or carpentry projects are often undertaken by an individual user and often involve cutting large pieces of wood. These pieces of wood are unwieldy due to their size and weight. As such, the wood is difficult to move, properly position, and to cut accurately.

It will be understood that the cutting board may be used with various, types, shapes, sizes, and configurations of wood other than sheets or panels. In fact, it is contemplated that the cutting board may be used with all manner of dimensional lumber or timber as well as wood of other shapes. In addition, the cutting board may be used to cut other materials other than wood. For example, the cutting board may be used to cut planar or other shaped plastics, composites, sheet rock, glass, and the like. Though the cutting board is described in one or more embodiments with regard to cutting wood with a circular saw, it is noted that wood may also be shaped or cut on the cutting board by various tools having various cutting blades, such as but not limited to routers, jigsaws, and drills.

A standard 4×8 ft sheet of plywood weighs about 20-25 lbs at ¼ in thickness, about 40-50 lbs at ½ in thickness, and about 60-75 lbs at ¾ in thickness. In addition, furniture grade plywood is often larger than the standard 4×8 ft and thus is even heavier. Non-wooden materials may be just as heavy if not heavier. Furthermore, the size of the wood (or other material) itself is difficult for one user to manage. It can thus be seen that manipulating such large pieces of wood to make accurate cuts is difficult for a single user if the wood is supported only by a user between saw horses, which is the prior art method of support.

Other than their size and weight, another reason large pieces of wood are difficult to cut is that the cut weakens the wood causing the wood to bend (if unsupported) as it is cut. As a cut extends into the piece of wood, there may be insufficient material to support portions of the wood beyond the cut. The wood may then bend at the cut. This can cause the wood to pinch the cutting blade which may cause the blade to get caught or bind. Also, this bending may also cause the cutting blade to damage any veneers or other surfaces of the wood. In some cases, the wood may crack due to bending. In addition, the wood may even break and splinter as the cut extends further into the wood. This damage is highly undesirable, especially in finish carpentry or furniture building.

One traditional method to cut wood is on a table saw, utilizing the table of the saw to support the wood as it is cut. Generally however, the table of the saw is too small to fully support large pieces of wood. Thus, as the wood is cut, it may bend or break if not properly supported. Pieces of the wood may also fall off the table as it is detached by the cut. For this reason, it is considered unsafe for a single user to cut large pieces of wood with a small table saw. Thus, an additional person is necessary to support the wood as it is being cut. In many cases this help is unavailable or adds unwanted cost. Further, cutting with two or more people must be carefully coordinated if a straight cut is to be made because the wood must be advanced through the saw in a steady and straight motion to provide an accurate cut.

There are table saws having a large table area capable of fully supporting a piece of wood, however these saws are generally expensive and designed for operation within a workshop. As such, these table saws are immobile and not ideal for construction sites, remote locations, or small areas. In addition, access to such table saws is relatively limited due to their size and cost.

One common method of cutting large pieces of wood is to place the wood on one or more sawhorses and then cut the wood using a circular saw, handsaw, jigsaw, or the like. This elevates the wood such that a cutting blade may extend through the wood during the cut. For example, it is commonplace to cut wood with a handsaw or circular saw on a pair of sawhorses with one sawhorse at each opposing end. However, sawhorses provide little support for the center sections of the sheet or stick and thus the wood can bend, crack, splinter, or break during cutting. In addition, when a cut is completed, the cut pieces typically fall to the floor. This may be hazardous in some cases, and damages the wood.

Wood may also be cut on a table. However, the table must be are large size to fully support a large piece of wood. If the table is small, it offers little support and the wood may still bend, break, or crack. A large table is inconvenient or impossible to use or transport at some work sites. For example, the table may be appropriately sized for some projects, but either too large or too small for other projects. In addition, an individual builder or carpenter often does not have equipment, or resources to obtain or transport multiple tables for different projects. In some cases, even a single table would occupy too much space to be easily or conveniently transported by a user. Furthermore, because the cutting blade of a saw extends through the wood to make a cut, cutting on a table would damage the table. The cutting board herein, addresses the issues described above and provides additional benefits.

The cutting board will now be described with regard to FIG. 1A which illustrates an exemplary cutting board 104 comprising a body 112 having a work surface 120, and a plurality of openings 108. The cutting board 104 may also comprise one or more mounts, though mounts may not be provided in all embodiments. As will be described further below, the mounts may be used to connect a plurality of cutting boards 104 together.

Figure 1B:
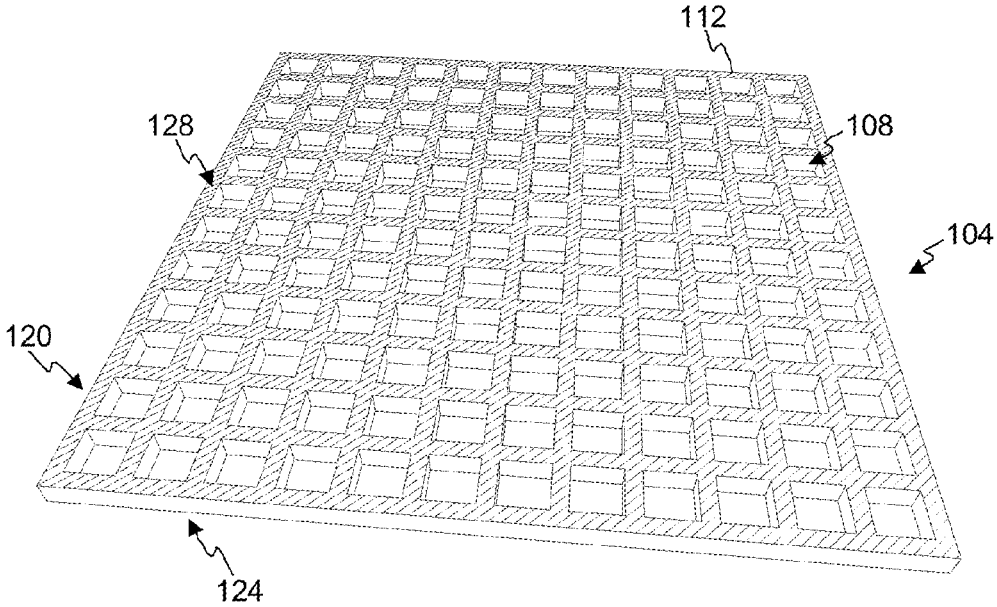
FIG. 1B is a perspective view of an exemplary cutting board having a textured surface.
Figure 1C:
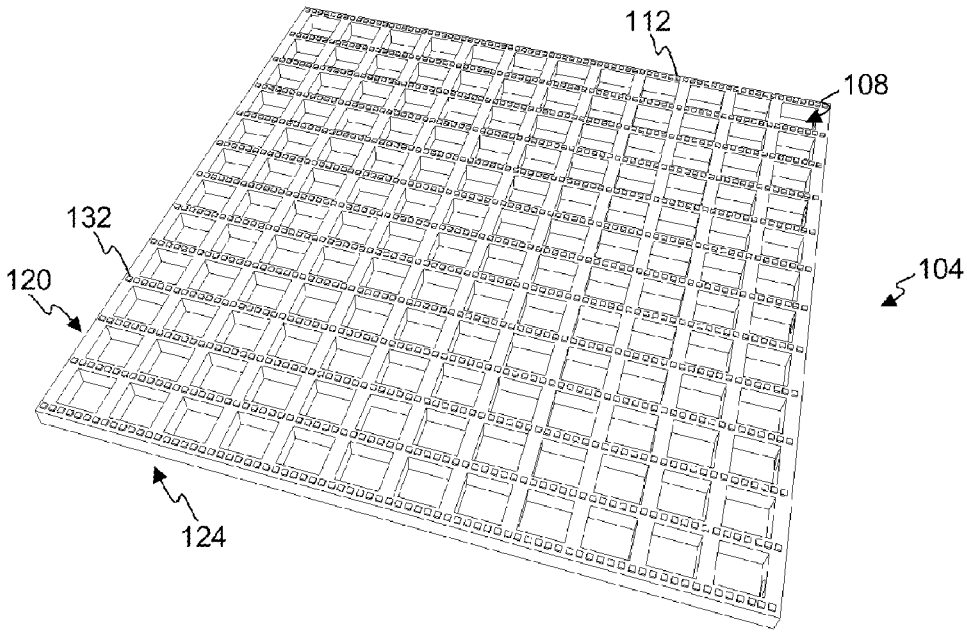
FIG. 1C is a perspective view of an exemplary cutting board having a dimpled surface.

In one or more embodiments, the work surface 120 provides a surface which supports the wood to be cut on the cutting board 104. The work surface 120 may be smooth in one or more embodiments, such as shown in FIG. 1A. In other embodiments, the work surface 120 may have a texture 128 or comprise a material which holds pieces of wood in place through friction, such as shown in FIG. 1B. In one embodiment, the work surface 120 may comprise a plurality of raised dimples 132 which support the surface area of a piece of wood, such as shown in FIG. 1C. The plurality of dimples 132 support a piece of wood across the wood's surface area, thus providing substantial support. In addition, the dimples 132 reduce or eliminate the likelihood that a cutting blade will cut into the cutting board 104 during cutting. Of course, dimples 132 are not required in all embodiments, and the cutting board 104 may be designed to be cut into during use, as will be described further below. It is noted that a cutting board 104 may have dimples 132 and be designed to be cut into in some embodiments.

Typically, the work surface 120 will be planar to allow the cutting board 104 to support various shapes of wood. As is known, dimensional lumber commonly comes in sheet or stick form having one or more planar surfaces. A planar work surface 120 is advantageous in that it provides support across these planar surfaces, rather than at one or more points on the planar surfaces. This prevents the wood from bending as it is cut, thereby allowing a precise cut to be made without the wood cracking, breaking, or otherwise being damaged.

It is noted that an additional or second work surface 124 may be provided in one or more embodiments. The second work surface 124 may be located opposite from the first work surface 120 such as shown in FIG. 1. The second work surface 124 may have the same or different attributes than the first work surface 120. For example, the second work surface 124 may be planar but have a higher friction surface or texture 128 to better hold pieces of wood in place during cutting. In one embodiment, the first work surface 124 may have a plurality of raised dimples 132, while the second work surface 124 does not. The second work surface 124 may also extend the usable life of the cutting board 104. For instance, if the first work surface 120 is worn or damaged, the user may continue using the cutting board with the second work surface 124.

The body 112 of the cutting board 104 may be rigid in one or more embodiments. This allows the cutting board 104 to provide a rigid work surface 120 which supports the piece of wood to be cut. As such, the cutting board 104 does not itself need to be reinforced or supported, and can provide a straight planar work surface. This is highly advantageous because the cutting board's rigidity allows the cutting board to provide a planar work surface 120 regardless of the condition of the surface the cutting board is placed on. For example, the cutting board 104 may provide a rigid planar work surface 120 even when placed on uneven ground or across sawhorses or other supports.

In one embodiment the cutting board is supported at two ends by a saw horse. When a cut is made, the saw blade extends through the sheet or stick being cut, but does not cut all the way through the cutting board 104. Because the saw blade does not cut through the entire thickness of the cutting board, the cutting board is reusable cut after cut.

The body 112 may be formed from a variety of materials. In general, the material or materials used will be rigid while not harmful to cutting blades in case a blade should come into contact with the cutting board 104. This is advantageous because it prevents damage to cutting blades while providing a rigid work surface 120.

For example, the body 112 may be configured so that it may be cut into when a user is cutting a piece of wood on the cutting board 104. This may be accomplished by forming the body 112 with a material or materials which are not harmful to (e.g. do not dull) cutting blades. In one or more embodiments, the body 112 may comprise materials or have a size which allows the body to remain rigid and planar even though one or more cuts have been made into the body. In this manner, wood may be placed directly on the cutting board 104 and cut without a protective barrier or buffer between the wood and the cutting board.

Figure 2A:
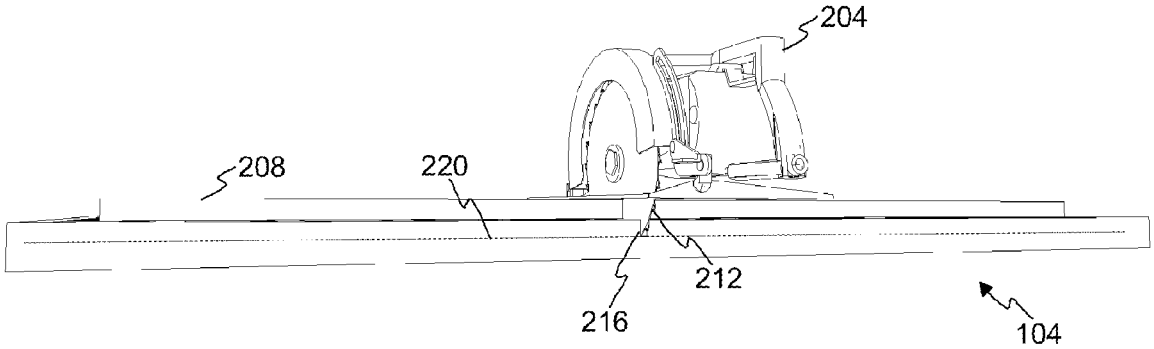
FIG. 2A is a side perspective view of a channel in an exemplary cutting board.

As is known, cutting blades generally extend through the piece of wood they are cutting. This is illustrated in FIG. 2A which shows a sheet of plywood 208 and a circular saw 204 on an exemplary cutting board 104. As can be seen, the circular saw's blade 212 is set to extend slightly beyond the width of the plywood 208 to ensure a complete cut. As the plywood 208 is cut, the saw blade 212 cuts a narrow channel 216 into the cutting board 104. Similarly, a router bit, jigsaw blade, or the like may also cut into the cutting board 104 during use. This is highly advantageous in the case of router bits because there are times when a user may position a router bit to use only a portion of the bit to cut or shape a piece of wood. In these situations, the user does not have to worry if the remainder of the router bit cuts into the cutting board 104.

The cutting board's ability to remain useful (e.g. remain rigid and planar) despite being cut into is highly advantageous. With this ability, a user is able to cut directly on the cutting board without worrying that the cutting board 104 will be cut into two pieces or seriously damaged. The user is then also able to work more quickly because pieces of wood may be directly on the cutting board without a protective barrier or buffer between the cutting board 104 and the wood.

It is noted that, after prolonged use, the cutting board's work surface 120 may have a numerous channels 216 cut into it, making it less effective at supporting the wood. However, since each channel 216 will typically be only the width of a saw blade, such as shown in FIG. 2A, such extensive damage will likely occur only after an extended period of time. It is noted that in a case where the work surface 120 can no longer be used, the user may simply use a secondary work surface 124.

A user may reduce the amount of damage caused by successive cuts by cutting along existing channels which have previously been cut into the cutting board 104. It is contemplated that a cutting board 104 may be manufactured with channels 216 in its work surface 120 in one or more embodiments. Because the cut or manufactured channels 216 will typically be narrow in width, the cutting board 104 is still able to provide support across the surface area of a piece of wood.

Figure 2B:
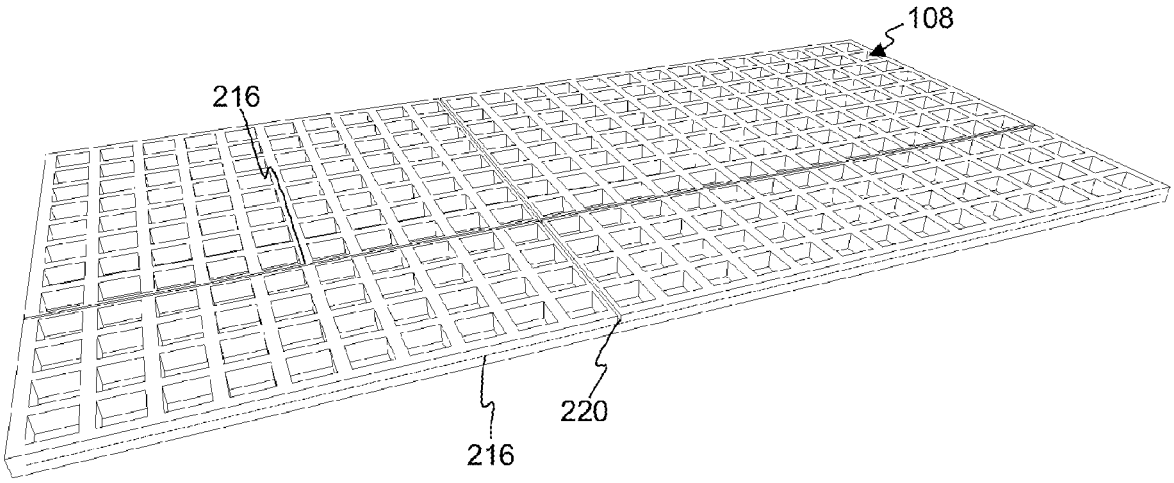
FIG. 2B is a perspective view of channels in an exemplary cutting board.

An exemplary cutting board 104 having manufactured channels 216 is shown in FIG. 2B. There are two channels 216 shown in FIG. 2B, however, it will be understood that fewer or additional channels 216 may be provided. The channels 216 may be made at locations where cuts are likely to be made. For example, as shown, the channels 216 are centered on the cutting board 104. In this manner, a cut may be made through the center of a piece of wood without cutting into the cutting board 104. Of course, as stated, a cutting board 104 need not have manufactured channels 216, and a user may cut his or her own channels into the cutting board.

During cutting, the user will preferably set his or her cutting blade such that the blade does not cut too deeply into the cutting board 104. The cutting board 104 may provide one or more guide marks 220 along one or more of its edges to allow a user to correctly set the depth of the cutting blade. The guide marks 220 may be printed on the cutting board 104 with ink or by indentations or protrusions from the cutting board's body 112. Typically the guide marks 220 will be in the shape of one or more lines.

Figure 6A:
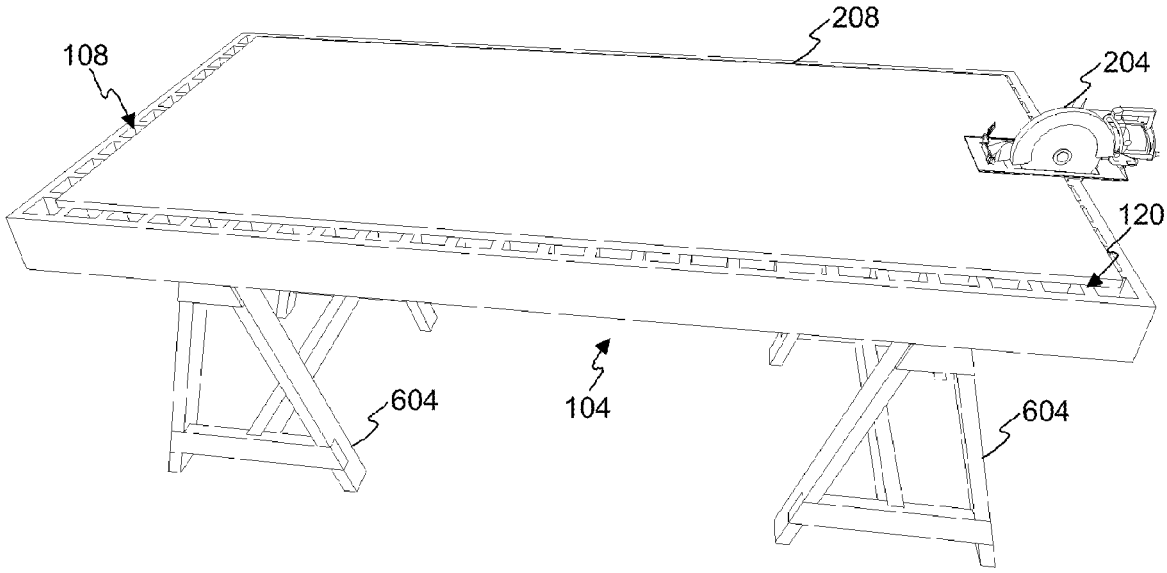
FIG. 6A is a perspective view illustrating use of an exemplary cutting board on sawhorses.

Of course, depending on the size of the embodiment, a user may damage or destroy a cutting board 104 by cutting too deeply or through the cutting board. Thus, in some embodiments, the cutting board 104 may have a height which is greater than the maximum depth of a particular cutting blade. For example, the body 112 of a cutting board 104 may have a height greater than the maximum depth of a circular saw blade, jigsaw blade, or router bit. FIG. 6A illustrates a tall cutting board 104. Because, different tools have different maximum depths of cut, it is contemplated that cutting boards 104 may be manufactured for use with particular tools in one or more embodiments. For example, a cutting board 104 having a body 112 with a first height may be designed for use with a first cutting tool, such as a circular saw. In general, the height of the body 112 will be set such that a cut at maximum depth does not reduce the rigidity of the cutting board 104. For example, in one embodiment, the height may be twice (or more) the maximum depth of cut.

It is noted that typically, the height of the cutting board 104 will be set to provide enough material to make the cutting board 104 rigid along its length or width. Of course other factors may be taken into account such as the cutting board's weight and the size of the wood to be cut on the cutting board. It is contemplated that the cutting board 104 may be flexible in some embodiments. For example, the cutting board 104 may have a reduced height, be made of flexible material(s), or both. This allows the cutting board 104 to be rolled or folded for easier storage and transport. Though this is advantageous, it is noted that flexible cutting boards may need to be supported to provide a planar work surface in some cases. The cutting board 104 may also be made in different sizes. Although shown in sheet proportions in the figures, it is contemplated that the cutting board may be made in any dimensions, such as for cutting lumber, sheets, or other dimensional woods or other materials.

In one or more embodiments, the cutting board 104 may be formed from a single material. Some exemplary materials from which the cutting board 104 may be formed include but are not limited to, plastics, wood, fiberglass, and composite materials. In other embodiments, the cutting board 104 may be formed from a combination of materials. In one embodiment the body has an upper layer made of softer, more easily cut material, on top of a more ridged bottom layer.

For example, a first material may be used near or at the work surface 120 while a second material may be used for the remainder of the cutting board. In one embodiment, the first material may be one that does not harm cutting blade while the second material may be one that provides a rigid structure to the cutting board 104. In another embodiment, the cutting board 104 may comprise reinforcing members or structures of various materials. For example, harder plastics, metals, composites, or other rigid materials may be embedded within or attached to the cutting board's body 112 to provide increased rigidity. Because these reinforcing materials may damage cutting blades if cut into, the reinforcing materials will typically be located away from the work surface 120 or work surfaces of the cutting board 104. The reinforcing materials may also be identified by one or more guide marks 220 as described with regard to FIGS. 2A and 2B.

Referring back to FIG. 1, as stated, the body 112 may have a plurality of openings 108 in one or more embodiments. The openings 108 provide several advantages. The openings 108 reduce the weight of the cutting board 104 making the board easier to transport and set up for use. In addition, the openings 108 provide paths for sawdust to escape. In this manner, sawdust does not build up during cutting. Also, the openings 108 provide airflow which can help in keeping the cutting blade cool during cutting. This reduces the likelihood of the wood burning as it is cut due to friction between the cutting blade and the wood. Further, the openings 108 provide numerous convenient locations to attach one or more clamps, straight edges, guides, or other tools. In this manner, a variety of tools may be used with a various shapes of wood on the cutting board.

The openings 108 also reduce the amount of material of the cutting board 104 that may be cut into during use. As described above, a cutting blade may extend beyond a piece of wood and cut into the cutting board 104 during cutting. Obviously, there is no cutting board material at the openings 108, thus reducing the amount of material cut into. This reduces the amount of resistance against the cutting blade caused by cutting into the cutting board 104 which is beneficial to the user and the user's cutting blades.

It is noted that the openings 108 also provide convenient areas for drilling holes into wood. The user may position a piece of wood and his or her drill bit over an opening 108 and drill a through hole without drilling into the cutting board 104. Of course, a user may drill into the cutting board 104 as well. Because the cutting board 104 may be designed to be cut into, drilling into the cutting board does not damage the cutting board 104 or drill bits. In fact, by drilling a hole in a piece of wood over a portion of the cutting board's work surface, tear out may be reduced or eliminated because the work surface supports the bottom end of the wood as the drill bit drills a hole through the wood. This support prevents splintering of wood or other material at the exit hole from the drill. In one embodiment, one or more portions of the cutting board are solid, without openings 108, to provide support areas for drilling.

In one or more embodiments, the openings 108 extend through the cutting board 104 such as shown in FIG. 1. The openings 108 may remain the same size and shape as they extend through the body 112 of the cutting board 104. Alternatively, the openings 108 may change shape or size as they extend thought the body 112. This is advantageous in that different work surfaces 120,124 may be created. For example, openings 108 may taper as they extend through the body 112 thus creating a first work surface 120 with larger openings, and a second work surface 124 with smaller openings.

Figure 3A:
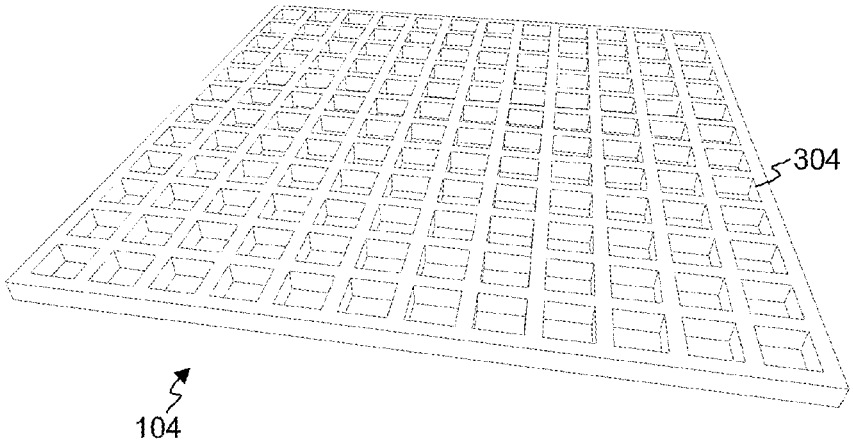
FIG. 3A is a perspective view of an exemplary cutting board with rectangular openings.
Figure 3B:
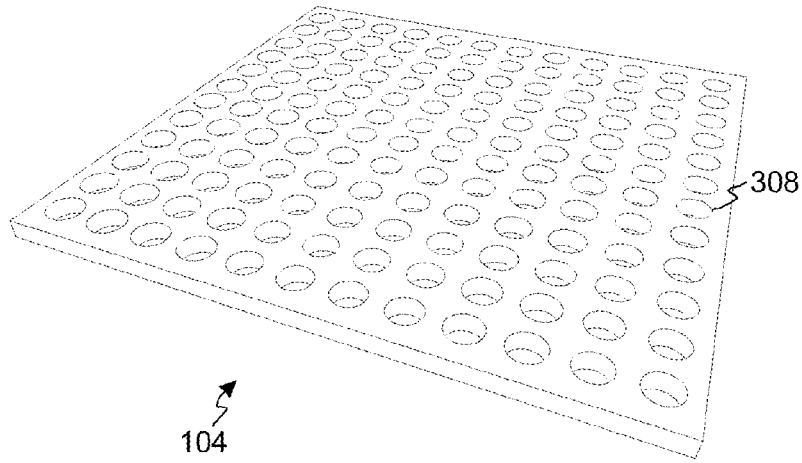
FIG. 3B is a perspective view of an exemplary cutting board with circular openings.
Figure 3C:
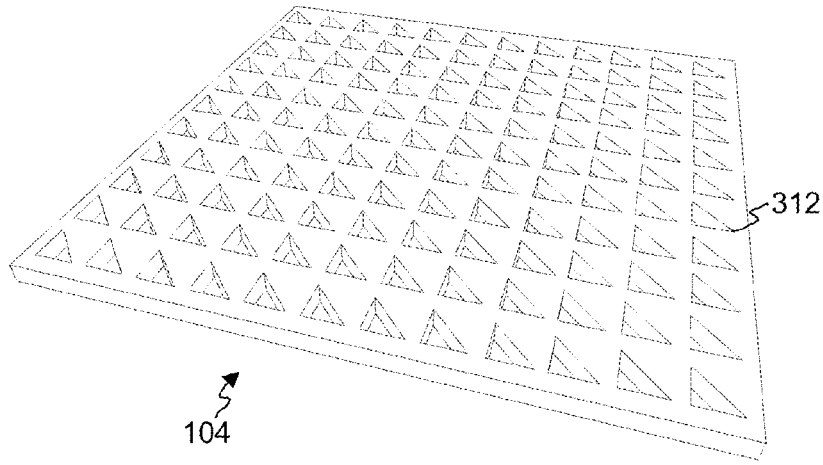
FIG. 3C is a perspective view of an exemplary cutting board with triangular openings.
Figure 3D:
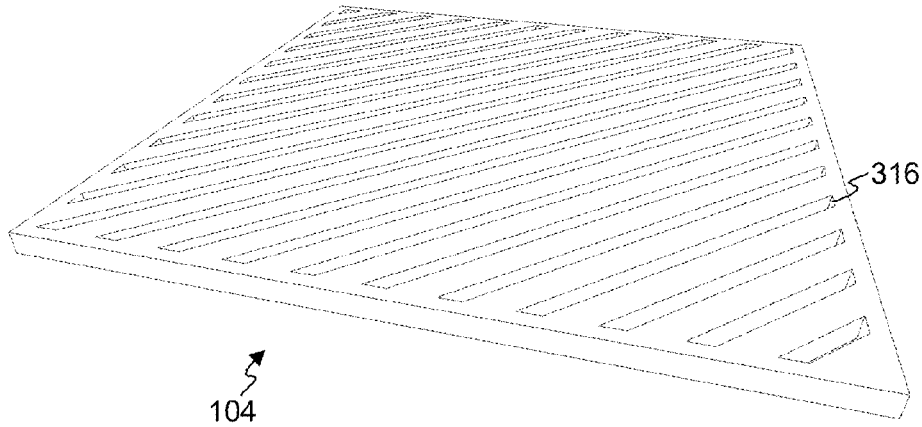
FIG. 3D is a perspective view of an exemplary cutting board with elongated openings.

The openings 108 may have a square or rectangular shape 304 in one or more embodiments, such as shown in FIG. 3A. As shown in FIGS. 3B and 3C, in other embodiments, the openings 108 may have a circular shape 308 or triangular shape 312. Of course, the openings 108 may have other shapes as well. Typically, the openings 108 of a work surface will have the same shape, such as in FIGS. 3A-3C, though it is contemplated that the openings of a single work surface may have various shapes. The openings 108 may be arranged in straight rows and columns, staggered rows and columns, according to various patterns, or randomly. As shown in the embodiments of FIGS. 3A and 3B for example, the openings 108 are arranged in straight rows and columns. The openings 108 may also be oriented at various angles. For example, in FIG. 3D, openings 108 of elongated polygonal shape 316 are oriented diagonally on the cutting board 104. In one embodiment, openings 108 may be 3 or 4 inches in size, though it is contemplated that the openings may be of any size.

It is contemplated that the cutting board 104 may have only a few openings 108 or no openings in some embodiments. In one embodiment, the cutting board 104 only has openings 108 at its edges such as to allow one or more clamps to be inserted therethrough. In another embodiment, the cutting board 104 has no openings 108. In this embodiment, the cutting board 104 may also comprise a work surface 120 that may be cut into. It will be understood that cutting boards 104 with no openings 108 may share one or more features or elements of cutting boards with openings such as those described herein.

The body 112, and thus the cutting board 104, may also have a variety of shapes. As shown in FIG. 1 for example, the cutting board 104 is rectangular in shape. This allows the cutting board 104 to support rectangular pieces of wood of similar size as the cutting board, or smaller pieces of wood of any shape. The cutting board may also be circular, triangular, polygonal, or various other shapes.

The cutting board's body 112 may be various sizes. The size of the cutting board 104 may be set based on the size of the wood to be cut on the cutting board. For example, in the case of 4×8 ft panels, plywood, or the like, the cutting board 104 may be 4×8 ft or around 4×8 ft in length and width. This allows the cutting board to support a full sheet of plywood across the plywood's surface area. As stated, the height of the cutting board 104 may be based on the desired rigidity (or flexibility) of the cutting board. This allows the cutting board 104 to be used on a variety of even or uneven surfaces or across various supports, such as sawhorses or the like. In one or more embodiments, the cutting board 104 may have a height of 1 in to 4 in. Of course a cutting board 104 may be other heights as well.

The size of the cutting board 104 may be determined by convenience in one or more embodiments. For example, the cutting board 104 may be sized such that it is easy for a user to carry. In general, sizing the cutting board 104 in this manner means a smaller size (and thus a lower weight). The cutting board 104 may also be sized such that it fits into a particular vehicle or type of vehicle for transport. For example, a 4×8 ft cutting board 104 may not fit into a car and thus the cutting board 104 may be sized smaller, such as 3×3 ft, 4×4 ft, 5×5 ft, or other size, to fit into a car.

It is noted that smaller size cutting boards 104 may not be big enough to support some pieces of wood. For example, a 4×4 ft cutting board would not be able to fully support a 4×8 ft piece of plywood. To address this issue, it is contemplated that the cutting board 104 may be modular in one or more embodiments. In general, a modular cutting board 104 comprises mounts which allow it to be connected to another cutting board 104. The connected cutting boards 104 provide a larger support area. Connecting two 4×4 ft cutting boards 104 results in a 4×8 ft cutting board which is sufficient to support the 4×8 ft piece of plywood discussed above.

Figure 4A:
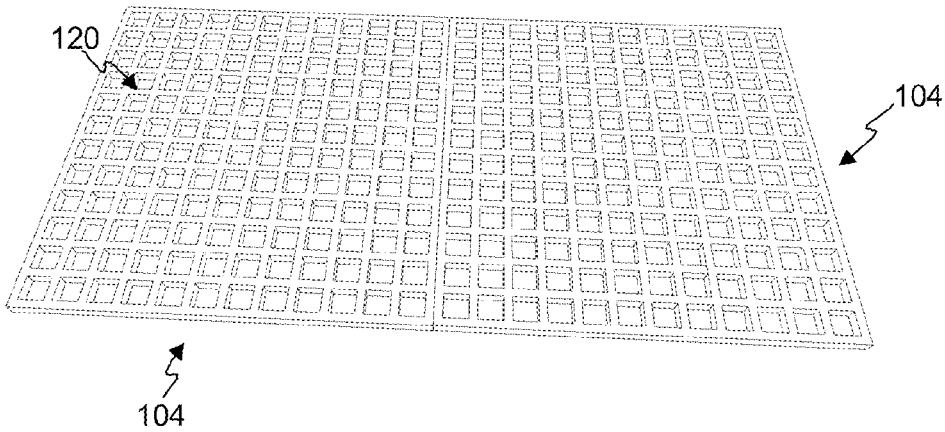
FIG. 4A is a perspective view of two exemplary modular cutting boards connected together.
Figure 4B:
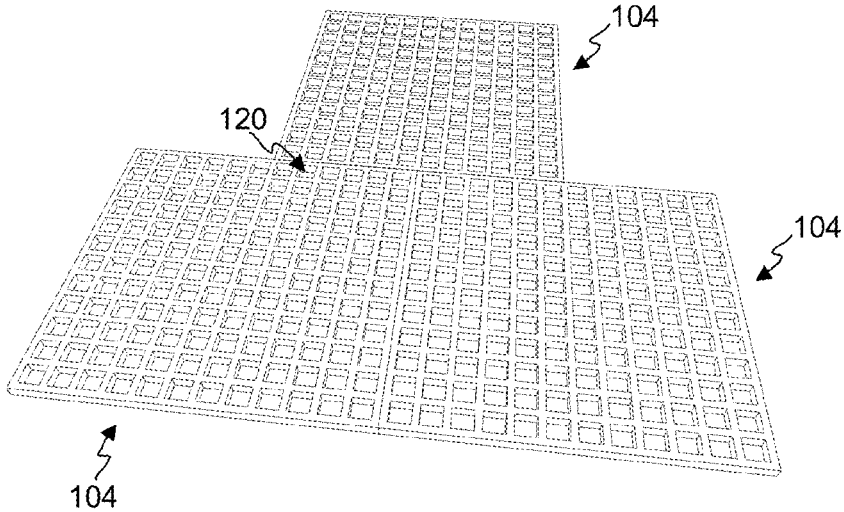
FIG. 4B is a perspective view of three exemplary modular cutting boards connected together.
Figure 4C:
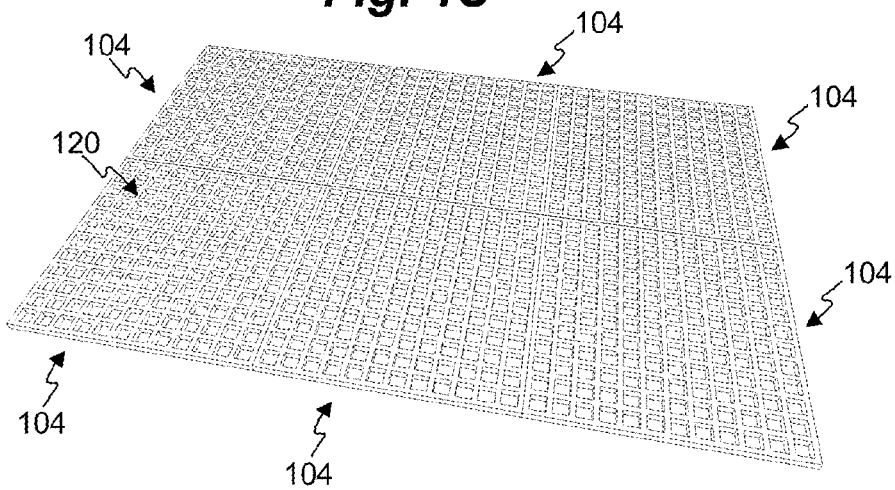
FIG. 4C is a perspective view of six exemplary modular cutting boards connected together.

In this manner, individual cutting boards 104 can have reduced size and be easy to convenient to carry and transport, while being connectable to support large pieces of wood. It is noted that larger cutting boards 104 may also be modular. For example, two 4×8 ft cutting boards 104 may be connected to form an 8×8 ft work surface 120. It is also noted that more than two cutting boards 104 may be connected as well, and that cutting boards may connect to one another at various locations along their edges. FIGS. 4A-4C illustrate this. As can be seen, cutting boards 104 may be connected such that they are aligned, as in FIG. 4A and 4C, or staggered as in FIG. 4B. Of course, it will be understood that other connections are possible.

Figure 5A:
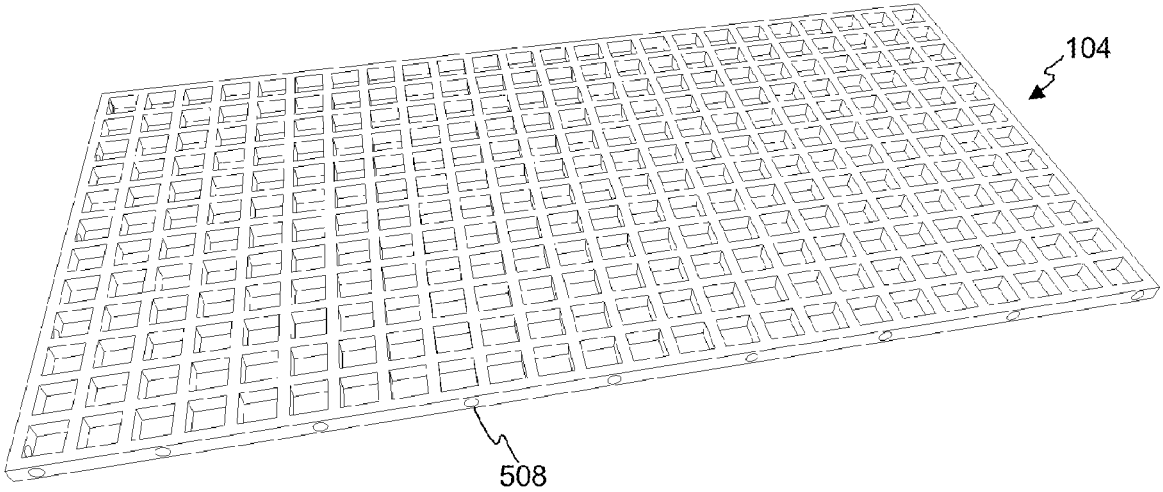
FIG. 5A is a perspective view of an exemplary cutting board having mounts.
Figure 5B:
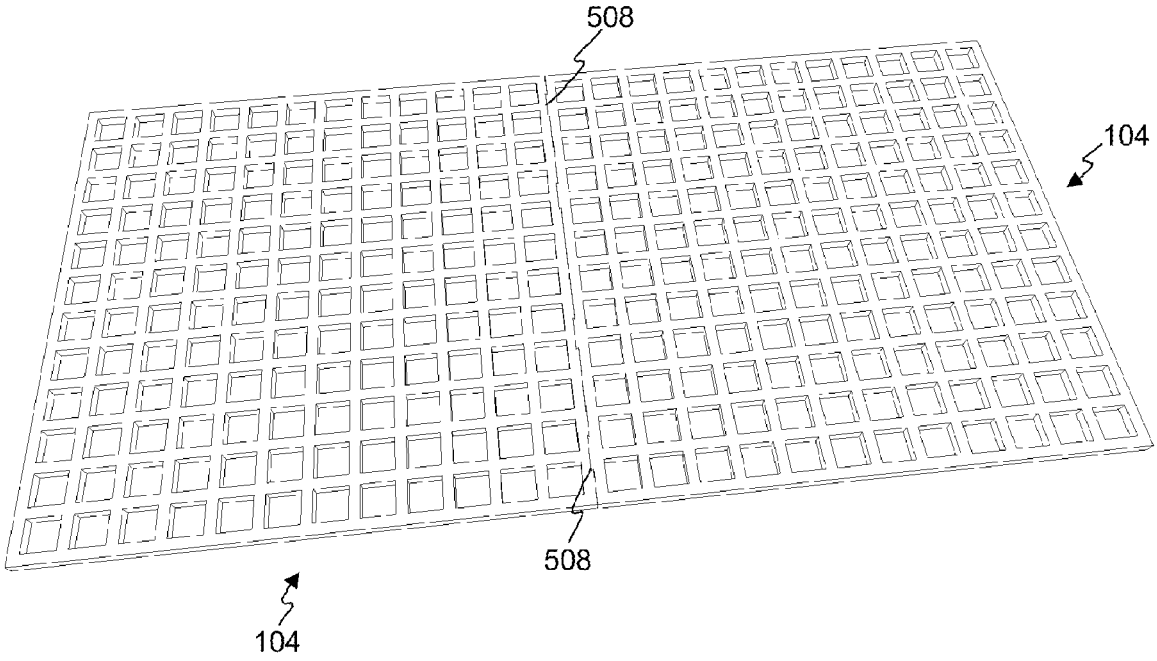
FIG. 5B is a perspective view of exemplary cutting boards having mounts.

Some exemplary mounts are shown in FIGS. 5A-5B. Referring to FIG. 5A, in one or more embodiments, a cutting board 104 may comprise one or more mounts 508 to allow a connection with another cutting board. In one or more embodiments, the mounts 508 may be located at the edges of a cutting board 104, such as shown.

The mounts 508 may be various structures configured to connect two or more cutting boards 104 together to form a larger planar work surface 120. In one or more embodiments, a mount 508 may be any structure, fastener, or the like which allows cutting boards 104 to be connected such that they provide a rigid and planar combined work surface 120. For example, as shown in FIG. 5A, a mount 508 may comprise an opening which allows one or more fasteners, such as screws, nuts, bolts, pins, or the like, to be inserted. When secured these fasteners connect two or more cutting boards 104 together providing a larger work surface 120. Mounts 508 may also comprise tabs and slots which engage each other to connect together, such as shown in FIG. 5B.

Figure 6B:
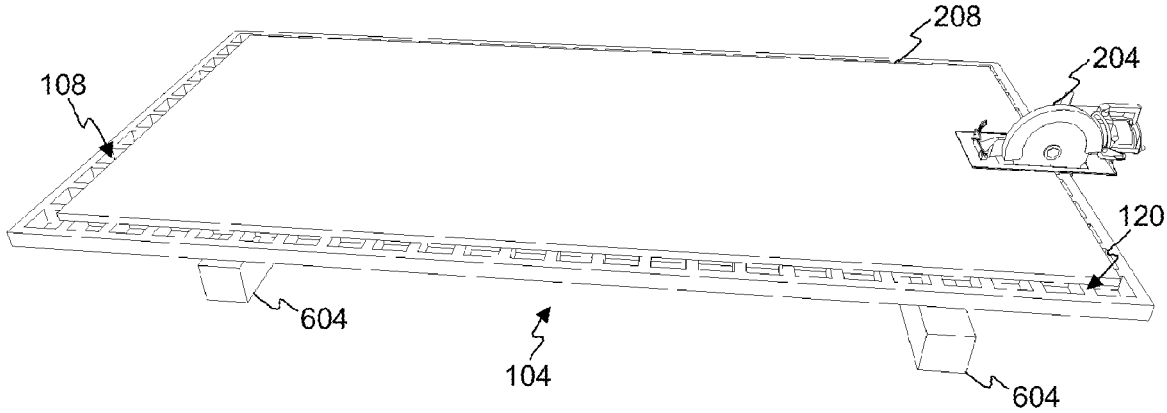
FIG. 6B is a perspective view illustrating use of an exemplary cutting board on 4×4 s.
Figure 6C:
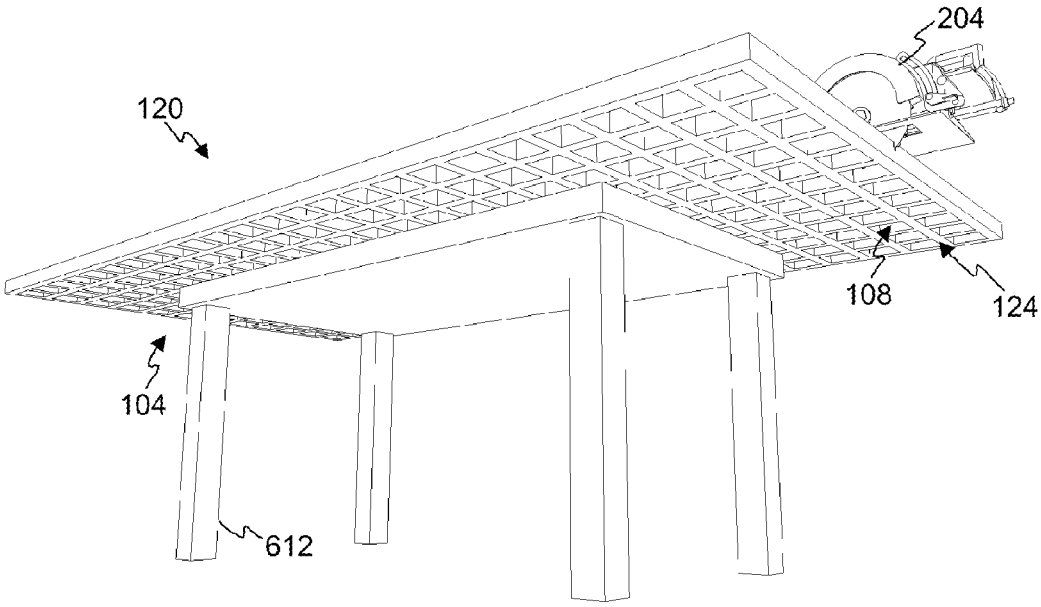
FIG. 6C is a perspective view illustrating use of an exemplary cutting board on a table.
Figure 6D:
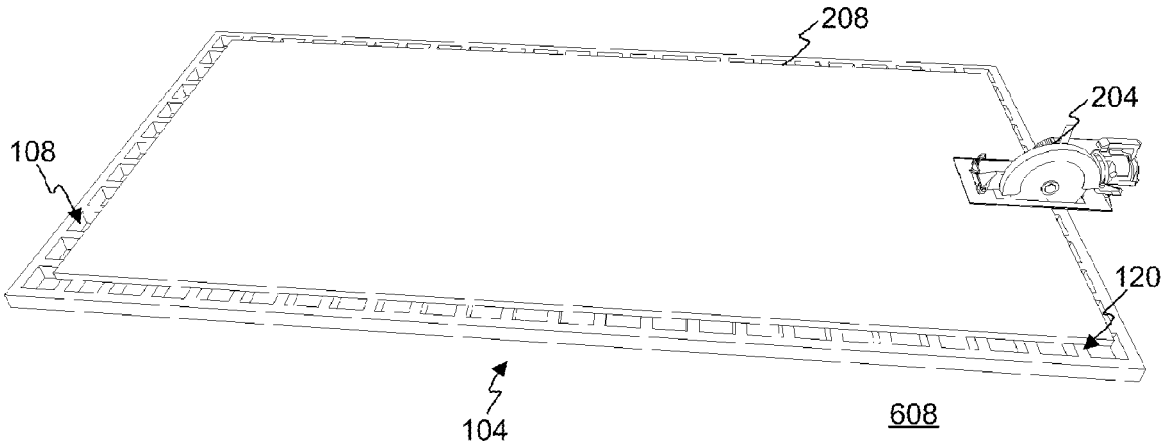
FIG. 6D is a perspective view illustrating use of an exemplary cutting board on the ground.

Exemplary use scenarios of the cutting board will now be described with regard to FIGS. 6A-6D. As can be seen, the cutting board 104 may be used on the floor or ground 608, such as shown in FIG. 6D, as well as in an elevated position, such as shown in FIGS. 6A-6C. If used on the floor, it prevents the saw blade from cutting into the floor or the blade from being damaged. If used on the ground, the cutting board, which is between the piece being cut and the ground, provides a desirably flat and stable work surface, and prevents the cutting blade from being damaged by the ground. It is contemplated that the cutting board 104 may also be placed at various angles or vertically allowing cuts to be made vertically as well as horizontally.

As shown, a piece of wood 208 has been placed on the cutting board 104. The wood 208 is supported across its surface area by the cutting board 104 which prevents the wood from bending and thus cracking or breaking, as it is cut. The wood 208 also covers a plurality of the cutting board's openings 108. As can be seen, this allows sawdust to escape through the openings 108 as the wood 208 is cut. To make a cut, a user may turn on the cutting tool (if applicable) and guide the tool's cutting blade through the wood 208. For example, with the circular saw 204 illustrated in FIGS. 6A-6D, a user may turn on the circular saw and guide the saw's blade forward to make a cut. As the cut is made, the wood 208 remains fully supported by the work surface 120 thus preventing the wood from bending. In this manner, cracking, breaking, and other damage to the wood 208 is prevented. In addition, pieces of wood or other material that are cut free are prevented from falling to the ground where damage to the wood or other material may occur.

In one or more embodiments, the cutting board's rigidity allows it to provide a rigid and planar work surface 120 even on an uneven floor or uneven ground 608. The cutting board's rigidity also allows it to span supports 604 such as the sawhorses illustrated in FIG. 6A and the 4×4 s illustrated in FIG. 6B. As can be seen, the cutting board 104 is capable of spanning the distance between the supports 604 while providing a rigid and planar work surface 120. Additional support could also be placed in the center of a large cutting board, and the design of the cutting board would prevent the support from being cut during the cutting process.

It is noted that, as stated above, the height of a cutting board 104 may be increased to increase the board's rigidity, such as shown in FIG. 6A (though as shown in FIG. 6B this height increase is not required in all embodiments). The cutting board 104 may also be used on a table 612 if desired. This is illustrated in FIG. 6C. By placing the cutting board 104 on the table 612, pieces of wood can be cut without damaging or destroying the table or the cutting blade. In addition, the cutting board 104 may provide work surface 120 which is larger than the table top.

Figure 7A:
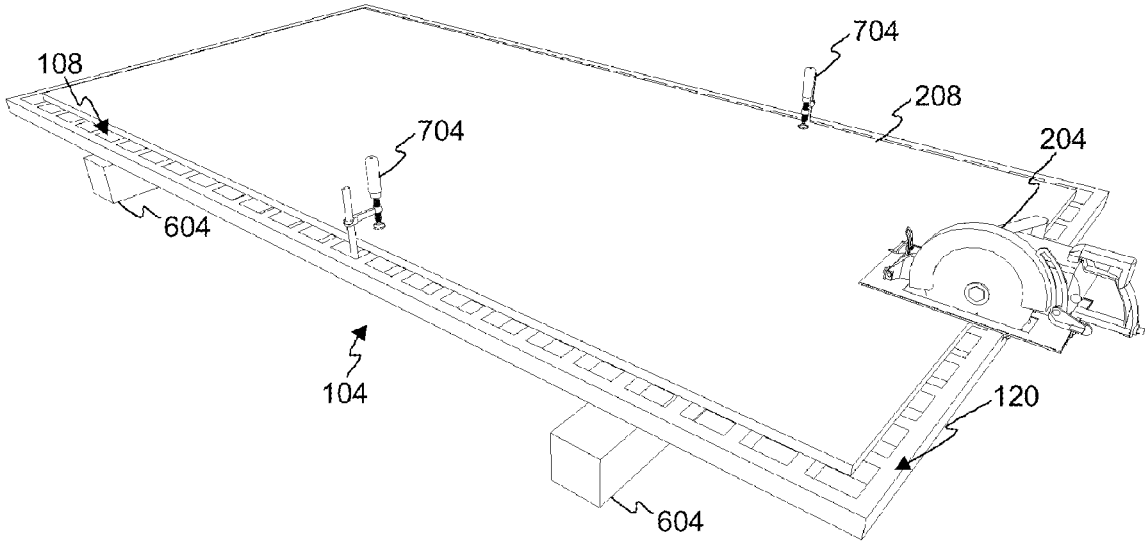
FIG. 7A is a perspective view illustrating use of an exemplary cutting board with clamps.
Figure 7B:
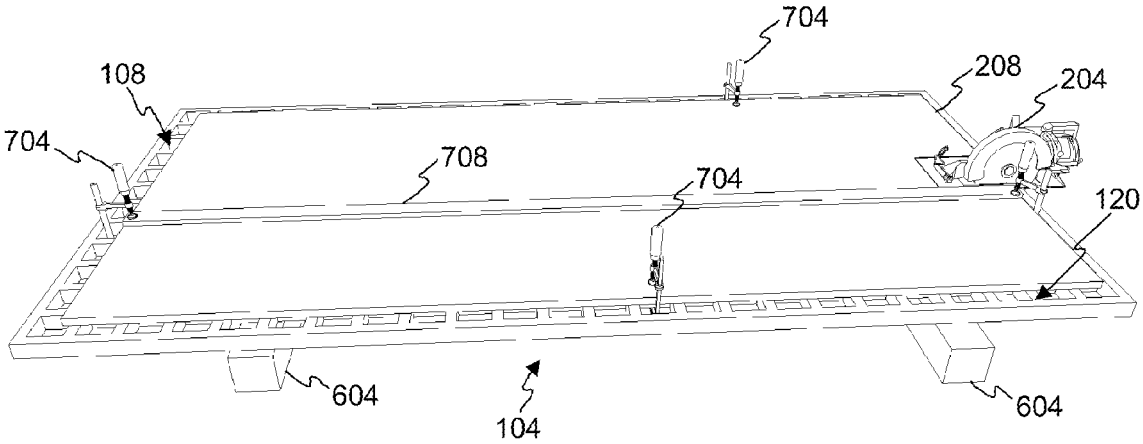
FIG. 7B is a perspective view illustrating use of an exemplary cutting board with a guide.

FIGS. 7A and 7B illustrate an exemplary cutting board 104 in use. As can be seen, a piece of wood 208 may be placed directly on the cutting board 104. If desired, one or more clamps 704 or the like may be used to secure the wood 208 to the cutting board 104. As stated, the cutting board 104 is advantageous in that its openings 108 provide numerous locations where one or more clamps 704 may be used even when the piece being cut is smaller than the cutting board. For example, as shown, a portion of the clamps 704 extend through the openings 108. Of course, clamps 704 are not required in all situations. In fact, it is contemplated that in some cases a user may stand on the wood 208 during cutting, allowing the user's weight to hold the wood in position during cutting.

Other tools may be secured to the cutting board 104 as well. For instance, as shown in FIG. 7B, a guide 708 may be secured to the cutting board to guide one or more cutting or shaping tools. As shown, the guide 708 is a straightedge which helps the user make a straight cut, such as with a circular saw 204. Of course other guides may be used. For example, a curved or other guide may be used to guide a router or other cutting or shaping tool.

While various embodiments of the invention have been described, it will be apparent to those of ordinary skill in the art that many more embodiments and implementations are possible that are within the scope of this invention. In addition, the various features, elements, and embodiments described herein may be claimed or combined in any combination or arrangement.

What is claimed is:

1. A method of cutting a panel comprising:

unrolling a cutting board comprising a flexible planar material from a rolled up state to a flat state;

placing the cutting board on one or more planar supports;

laying the panel on a work surface of the cutting board while the cutting board is in the flat state, wherein the panel covers one or more openings in the cutting board;

supporting the panel on the work surface of the cutting board;

cutting the panel into one or more pieces with a cutting tool having a cutting blade by advancing the cutting blade into the panel;

supporting a portion of the panel beyond the cutting blade;

cutting into the work surface with the cutting blade as the panel is cut; and continuing to support the one or more pieces of the panel on the work surface after cutting is completed.

2. The method of claim 1 further comprising connecting one or more additional cutting boards to the cutting board by engaging one or more mounting structures at the periphery of the cutting board with one or more corresponding mounting structures at the one or more additional flexible cutting boards.

3. The method of claim 1 further comprising:

inserting a clamp through at least one of the one or more openings; and clamping the panel to the cutting board with the clamp.

4. The method of claim 1, wherein the cutting blade is circular in shape.

5. The method of claim 1 further comprising rolling the cutting board from the substantially flat state back to the rolled state.

* * * * *